US006190245B1

(12) United States Patent
Heidelberger et al.

(10) Patent No.: US 6,190,245 B1
(45) Date of Patent: Feb. 20, 2001

(54) QUARTER PAD SANDER

(75) Inventors: Richard A. Heidelberger, Wheatfield; David E. Baran, Buffalo, both of NY (US)

(73) Assignee: Dynabrade, Inc, Clarence, NY (US)

( * ) Notice: Under 35 U.S.C. 154(b), the term of this patent shall be extended for 0 days.

(21) Appl. No.: 09/138,158

(22) Filed: Aug. 21, 1998

(51) Int. Cl.[7] ..... B24B 23/00
(52) U.S. Cl. ..... 451/357; 451/359; 451/366
(58) Field of Search ..... 451/357, 359, 451/366

(56) References Cited

U.S. PATENT DOCUMENTS

| | | | |
|---|---|---|---|
| 2,873,561 | * | 2/1959 | Levine . |
| 4,052,824 | * | 10/1977 | Hutchins . |
| 4,071,981 | * | 2/1978 | Champayne . |
| 4,102,084 | * | 7/1978 | Bloomquist . |
| 4,175,359 | * | 11/1979 | Teague, Jr. et al. . |
| 4,592,170 | * | 6/1986 | Hutchins et al. . |
| 4,624,078 | * | 11/1986 | Van Rijen et al. . |
| 4,839,995 | * | 6/1989 | Hutchins . |
| 5,679,066 | * | 10/1997 | Butz et al. . |
| 5,885,146 | * | 3/1999 | Cockburn . |
| 5,919,085 | * | 7/1999 | Izumisawa . |

OTHER PUBLICATIONS

Nitto Kohki Co., Ltd.—sales literature—Model FS–100C/ Free Sander (Heavy Pneumatic Sander).*
Hutchins Mfg. Co.—sales literature—Model 7044/Water Bug II Wet Sander.*
Kovax Corp./ Eagle Abrasives, Inc.—sales literature—Model 873–WL/Orbital Wet Sander.*

* cited by examiner

*Primary Examiner*—Timothy V. Eley
*Assistant Examiner*—Willie Berry, Jr.
(74) *Attorney, Agent, or Firm*—Simpson, Simpson & Snyder, L.L.P.

(57) ABSTRACT

A hand operated orbital sander having a hand grip portion provided with a fluid supply inlet connected to a source of pressurized fluid and a fluid discharge; a base portion for mounting a sanding pad and having a chamber, a fluid inlet for directing fluid into the chamber and a fluid outlet for discharging fluid from the chamber; a resiliently deformable sleeve portion for connecting the base portion to depend from the hand grip portion and defining a conduit for placing the fluid outlet in flow communication with the fluid discharge; a fluid operated rotor rotatably supported by the base portion within the chamber and mounting an eccentric weight for imparting orbital movement to the base portion; and a flexible conduit for connecting the supply inlet to the fluid inlet to apply pressurized fluid to the rotor to effect rotation thereof.

13 Claims, 6 Drawing Sheets

FIG. 8
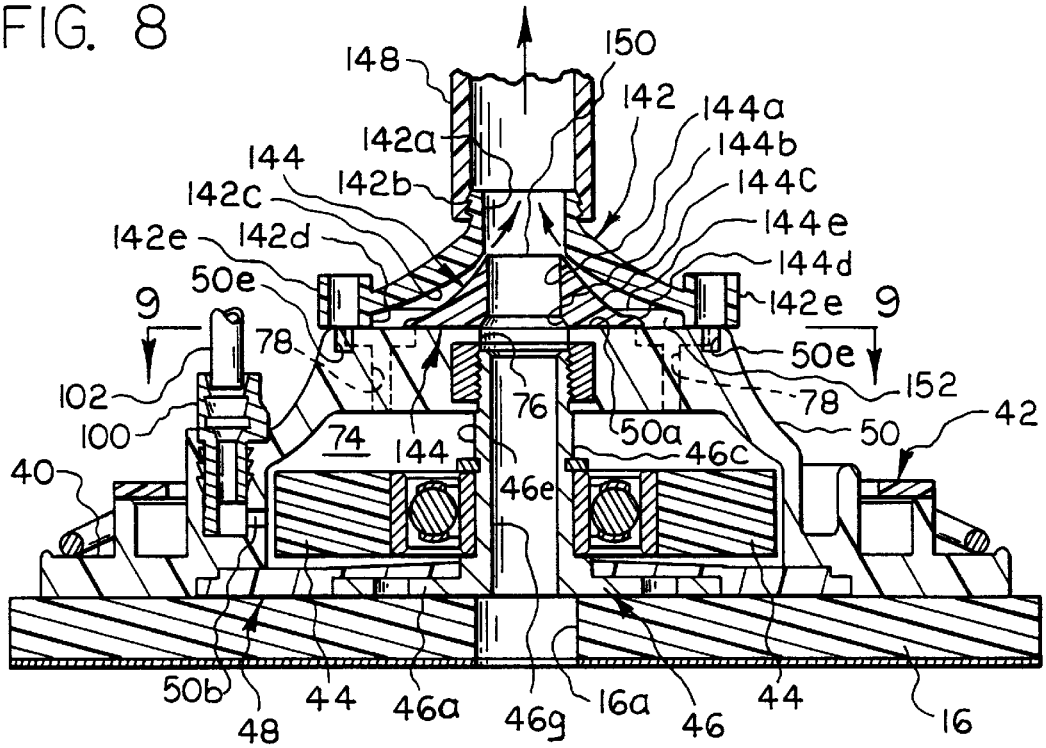
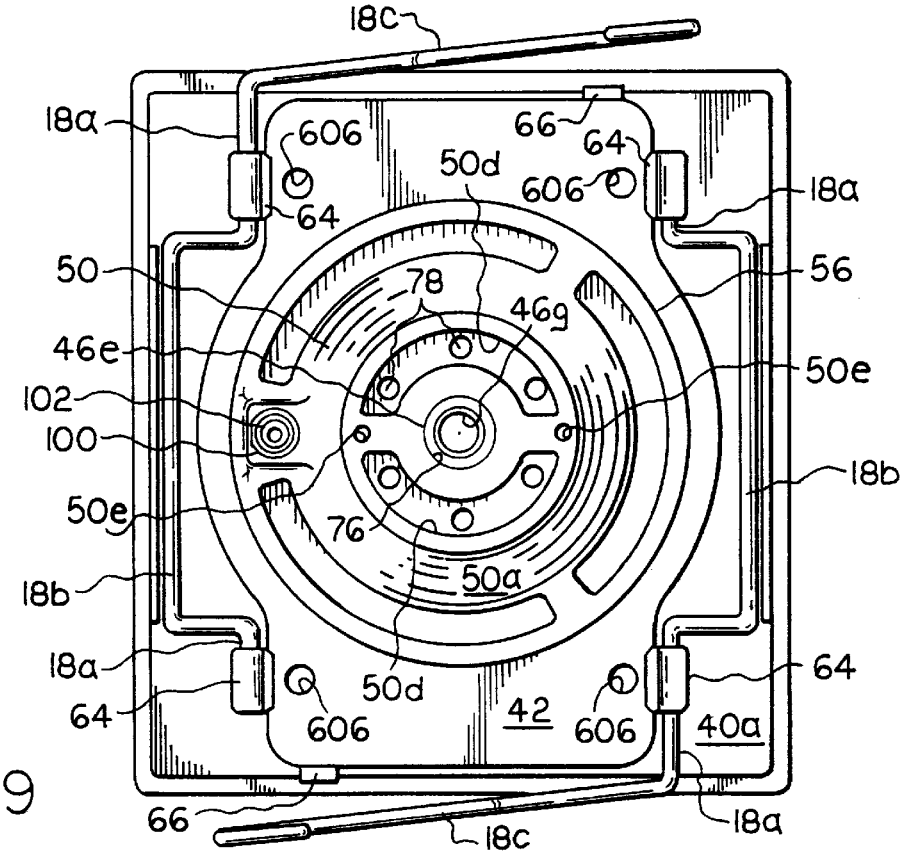
FIG. 9

QUARTER PAD SANDER

BACKGROUND OF THE INVENTION

The present invention relates to hand manipulated, pneumatically powered sanders.

In typical commercially available, pneumatically operated sanders, an air operated motor is arranged within a manually manipulated housing and connected by a drive shaft to a sanding pad via an eccentric drive.

In another construction, a sander is provided with an air turbine associated with a sanding pad supporting plate, and coupled to a manually manipulated housing by a plurality of resiliently deformable columns.

SUMMARY OF THE INVENTION

The present invention is directed towards an improved hand operated sander.

In accordance with a preferred form of the present invention, a sander is provided with a hand grip portion having a pressurized fluid supply inlet and fluid discharge; a base portion for mounting a sanding pad and having a chamber, a fluid inlet for directing fluid into the chamber and a fluid outlet for discharging fluid from chamber; a resiliently deformable sleeve having an annular mounting rim for supporting the base portion to depend from the hand grip portion and defining a conduit for connecting the fluid outlet to the fluid discharge; a fluid operated rotor or turbine wheel rotatably supported within the chamber and mounting an eccentrically located weight; a flexible conduit for connecting the fluid supply inlet to the fluid inlet of the chamber; and a clamping plate for releasably clamping the mounting rim of the sleeve to the base portion.

The base portion of the sander houses a rotor located remotely off that portion of the sander intended to be gripped by a user and the sleeve portion serves to isolate the latter from the vibrations imparted to a sanding pad by operation of the rotor and define an exhaust path for fluid discharged from the turbine.

The rotor is supported by a hollow mounting shaft, which allows the sander to be converted into a wet sander or to provide for a sanding dust exhaust system having a suction inlet located centrally of the sanding pad.

BRIEF DESCRIPTION OF THE DRAWINGS

The nature and mode of operation of the present invention will now be more fully described in the following detailed description taken with the accompanying drawings wherein:

FIG. 8 is an enlarged fragmentary view showing the sander adapted for providing a sanding dust exhaust system having a suction located concentrically of the sanding pad;

FIG. 9 is a top plan view of the base plate shown in FIG. 8; and

DETAILED DESCRIPTION

Figure 1:
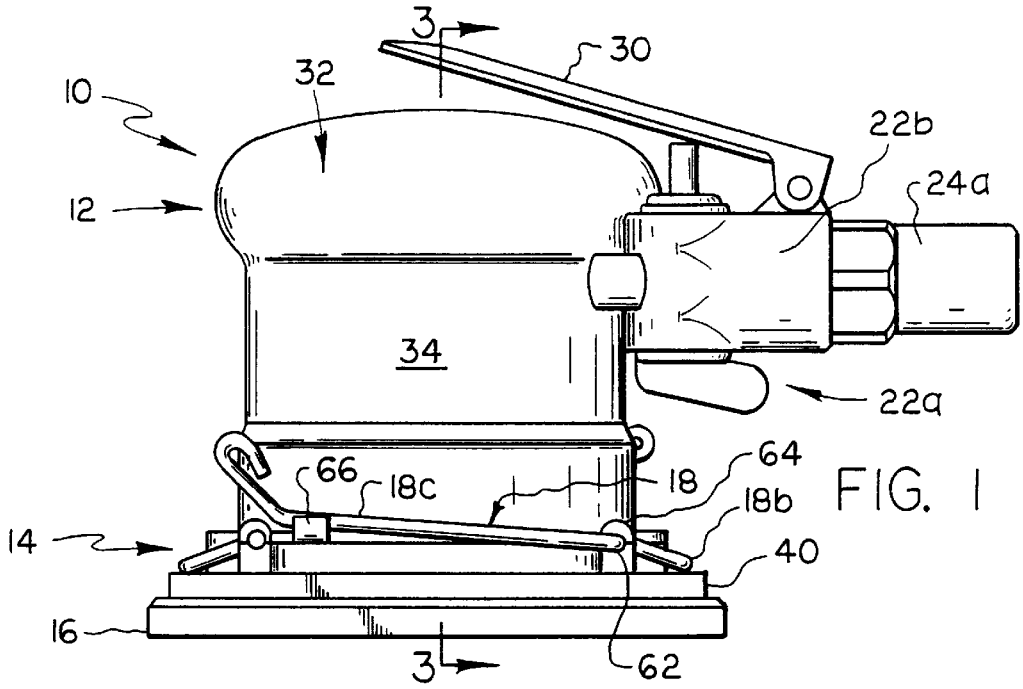
FIG. 1 is a view of a hand manipulated pneumatically operated sander formed in accordance with the present invention.

A manually manipulated fluid operated sander formed in accordance with the present invention is designated a 10 in FIGS. 1–4, and shown as including a hand grip portion 12, a base portion 14 for mounting a sanding pad 16 to which a quarter sized piece of sand paper may be suitably fixed, such as by conventional spring wire champs 18,18 pivotally carried by the base portion.

Hand grip portion 12 preferably includes a rigid, inverted generally cup-shaped shell 20, which is similar to the motor housing of the sander shown in commonly assigned U.S. Pat. No. 5,538,040 from the standpoint that it is formed with a first opening 22 connected to a suitable source of pressurized fluid, such as pressurized air, not shown, under the control of a flow control valve 22*a* mounted in association with an inlet conduit 22*b*, and a second opening 24 connected for example to a discharge conduit, not shown, mounting a muffler 24*a*. The inlet and discharge conduits are parallel, and cooperate to pivotally support a control lever 30 adapted to operator valve 22*a*, and are internally threaded to secure hose or other attachments.

Figure 3:
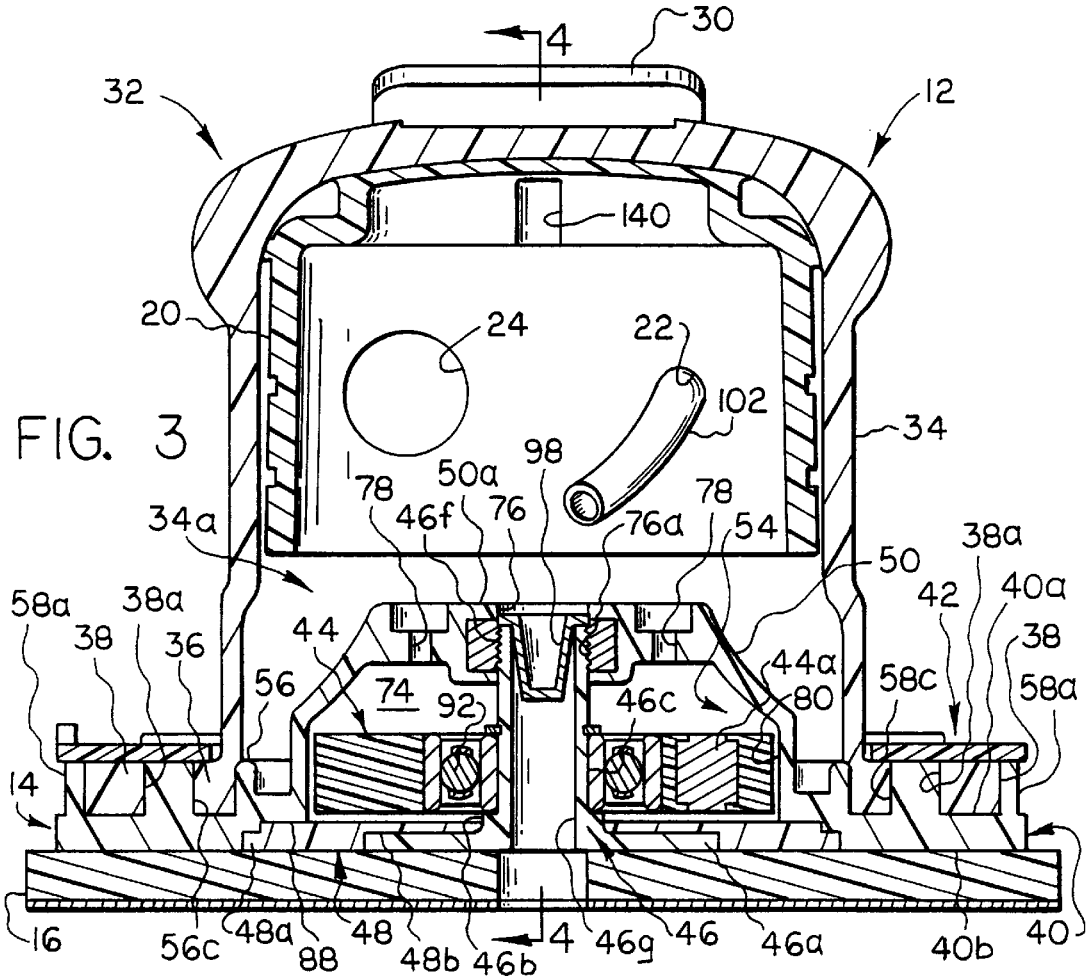
FIG. 3 is a vertical sectional view taken generally along the line 3—3 in FIG. 1.
Figure 4:
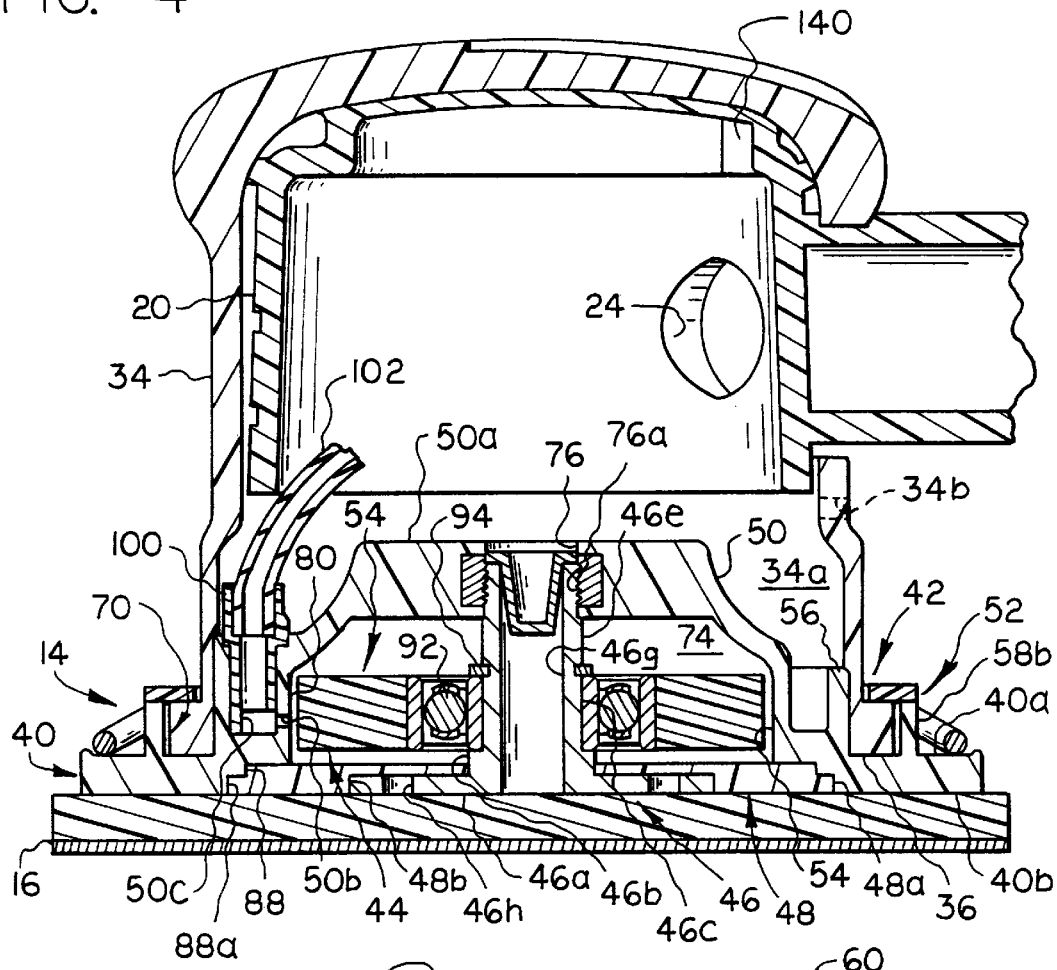
FIG. 4 is a vertical sectional view taken generally along the line 4—4 in FIG. 3.

Preferably, hand grip portion 12 includes an inverted, cup-shaped member 32 formed of a resiliently deformable material, which serves to both partially enclose shell 20 and provide a sleeve 34 for supporting base portion 14 beneath the shell as best shown in FIGS. 3 and 4. Sleeve 34 is generally cylindrical in configuration and has its open or free end formed with an annular, radially outwardly extending mounting flange 36 provided with oppositely extending, generally rectangular enlargements 38,38 formed with parallel, through locating openings 38*a*,38*a*. Sleeve 34, shell 20 and base portion 14 cooperate to define a chamber 34*a*.

Base portion 14 is shown in the drawings as generally including a base plate 40; a clamping plate 42; a rotor 44; a rotor mounting shaft 46; and a closure plate 48.

Base plate 40 is of generally rectangular configuration having upper and lower surfaces 40*a* and 40*b*; a centrally located dome portion 50 projecting above upper surface 40*a*; an aligning flange portion 52 projecting above upper surface 40*a*; and a rotor mounting recess 54 opening downwardly through lower surface 40*b* in alignment with dome portion 50. Aligning flange means 52 includes an inner annular locating flange 56 disposed concentrically of dome portion 50; an outer locating flange 58 having a pair of facing, U-shaped portions 58*a*,58*a* joined by a pair of facing arcuate portions 58*b*,58*b*, and a pair of parallel locating ribs 58*c*,58*c* arranged one within each of U-shaped. portions 58*a*,58*a*.

Figure 2:
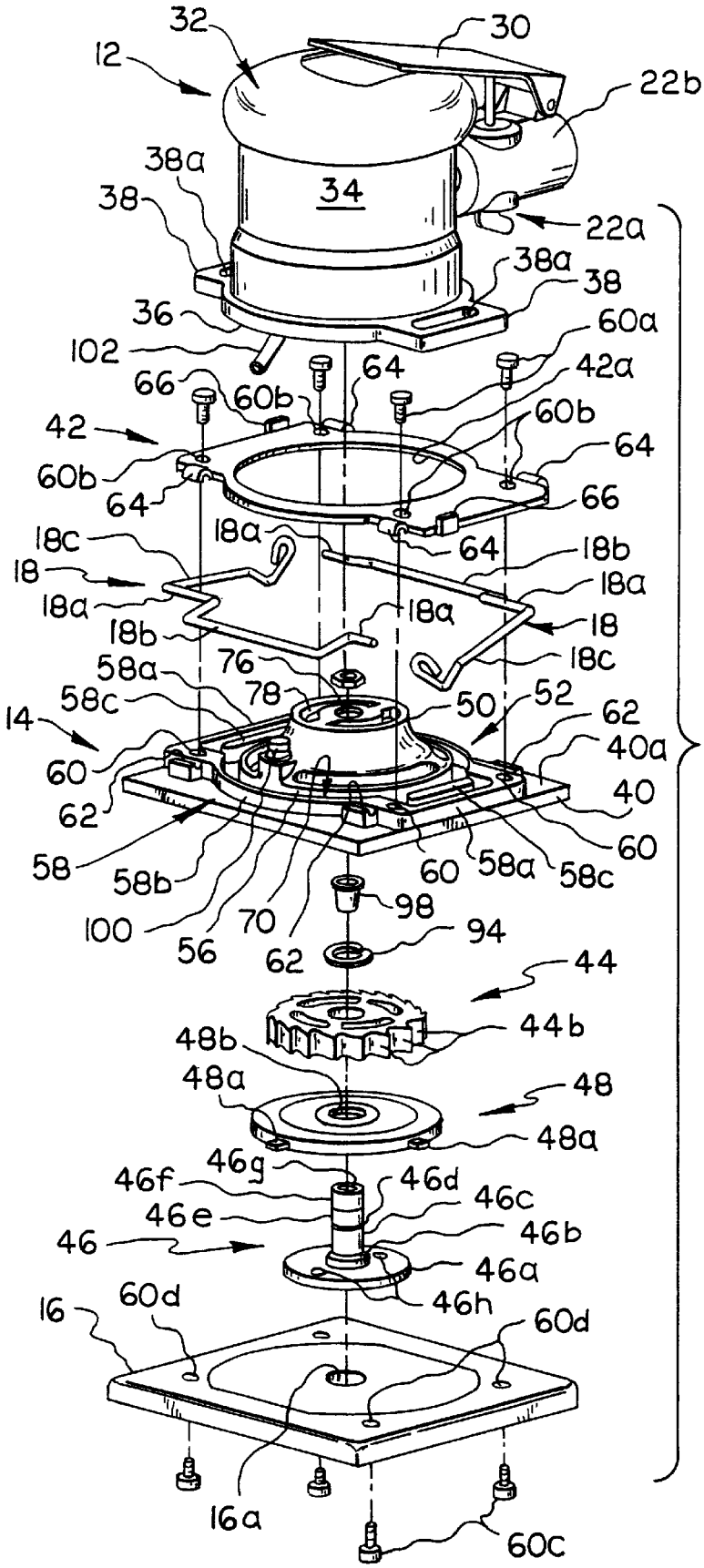
FIG. 2 is an exploded, prospective view of the sander.
Figure 5:
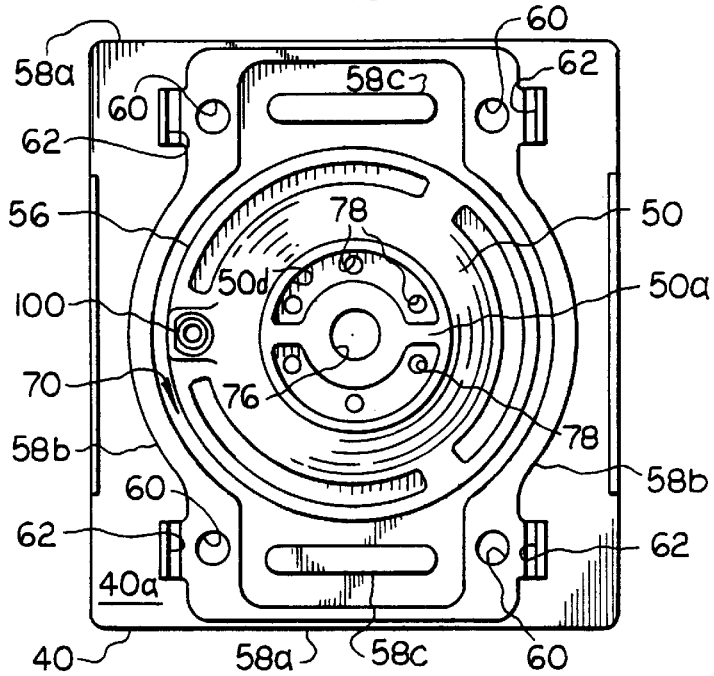
FIG. 5 is a top plan view of the base portion of the sander.

Base plate is formed with four screw-threaded openings 60, best shown in FIGS. 2 and 5, which extend vertically through outer locating flange 58 for receiving screws 60*a* extending through bore openings 60*b* formed in clamping plate 42 and screws 60*c* extending through bore openings 60*d* formed in sanding pad 16 for mounting clamping plate and pad adjacent the upper and lower surfaces of plate 40. Outer locating flange 58 is also formed with four parallel, upwardly opening, concave mounting channels 62—62, which are arranged for alignment with four parallel, downwardly opening, concave mounting channels 64—64 formed integrally with clamping plate 42. As will be apparent, channels 62 and 64 cooperate to define two pairs of aligned pivotal bearing supports for a pair of aligned pivot portions 18*a*,18*a* of each of wire clamps 18,18 disposed on opposite sides of sand paper clamping portions 18*b*,18*b*. Tabs 66,66 are arranged to engage with handle portions 18*c*,18*c* of the wire clamps in order to releasably retain clamping portions 18*b*,18*b* in clamping position in which they engage with a sheet of sand paper applied to the lower surface of sanding pad 16. Alternately, sanding pad 16 may be attached by Velcro.

As will be apparent, the tightening of screws 60*a* serves to clamp clamping plate 42 downwardly against the upper surface of outer locating flange 58, whereby to confine annular mounting flange 36 within a continuous mounting recess 70 bounded by inner and outer locating flanges 56 and 58. Mounting recess 70 is sized to snugly receive sleeve mounting flange 36 in order to prevent, relative movement between the mounting flange and base plate 40 during use of the sander. The provision of mounting flange enlargements 38,38 and mounting recess portions 58*a*,58*a* prevents rotational movements of base plate 40 relative to the lower rim of sleeve 34 and maximizes the area and thus the strength of the joint:

therebetween.

Clamping plate 42 is formed with a centrally located clearance opening 42*a* sized to slidably receive sleeve 34 and extends outwardly therefrom sufficiently to overlie both annular mounting flange 36 and outer locating flange 58.

Rotor mounting recess 54 is shown in FIGS. 3 and 4 as defining an upper or exhaust air chamber 74 communicating with an upper outer surface 50*a* of dome portion 50 by a centrically located through opening 76 provided with screw mounting threads 76*a* and a plurality of air exhaust openings 78; an intermediate cylindrical rotor receiving chamber 80 sized to slidably and rotatably receive rotor 44, and a lower disc-shaped mounting chamber 88 opening through lower base plate surface 40*b*. The periphery of mounting chamber 88 is sized to slidably receive closure plate 48 to lie essentially flush with base plate lower surface 40*b* and is formed with one or more notches or radially outwardly opening recesses 88*a* sized to receive positioning lugs 48*a* formed integrally with the closure plate, whereby to prevent rotation of the closure plate relative to base plate 40.

Closure plate 48 is also formed with a centrically disposed, through, stepped opening 48*b* sized and shaped to slidably and rotatably receive an enlarged base flange 46*a* and an adjacent annular spacer or collar 46*b* defined by rotor mounting shaft 46. The fit of closure plate 48 within mounting chamber 88 and relative to annular spacer 46*b* seals recess 54 in order to prevent or minimize excape of pressurized air downwardly through base plate lower surface 40*b* whereby to avoid blowing of sanding dust about the work area.

Rotor mounding shaft 46 is also formed with a cylindrical bearing mounting surface 46*c*, which is sized to support a roller bearing device 92 serving to rotatably support rotor 44; an annular recess 46*d* for receiving a snap ring 94; and a shaft portion 46*e* having its upper or free end threaded at 46*f* for receipt within threads 76*a* of through opening 76. Snap ring 94 cooperates with annular spacer 46*b* to position bearing device 94 axially of mounting shaft 46 within chamber 80. Rotor mounting shaft 46 is also formed with an axially extending through opening 46g and a pair of openings 46*h*,46*h* formed in base flange 46*a* and sized to receive prongs of a manually operable tool, not shown, by which rotor mounting shaft 46 may be threaded into opening 76 in order to mount closure plate 42 and rotor 44 within the confines of recess 54. Opening 46*g* is normally closed by a removable plug 98 to prevent entry of sanding dust into the confines of the cavity bounded by sleeve 34 and to prevent loss of air thru passageway 46G.

Rotor 44 is provided with an eccentrically located weight 44*a* serving to impart orbital movement to base portion 14 incident to rotation of rotor 44 about an axis extending axially of rotor mounting shaft 46, and a plurality of annularly-spaced rotor vanes 44*b*. Pressurized air is directed against vanes 44*b* to impart rotation to rotor 44 via an orifice 50*b* extending inwardly through dome portion 50 from adjacent the lower end of an upwardly opening recess 50*c* sized to receive a mounting fitting 100 for receiving one end of a flexible tube 102. The opposite end of tube 102 is disposed in flow communication with inlet opening 22.

In operation, depression of control lever 30 permits the flow of pressurized air through valve 22*a*, flexible tube 102, recess 50*c* and orifice 50*b* to effect rotation of rotor 44. Due to the provision of weight 44*a*, rotation of rotor 44 induces a side-wise directed orbital movement to base plate 40, and thus sanding pad 16, relative to hand grip portion 12, which may remain relatively stationary due to flexures of sleeve 34.

Air passing from engagement with vanes 44*b* flows through exhaust air chamber 74 and exhausts therefrom through exhaust openings 78 into chamber 34*a*, which defines a conduct placing openings 78 in flow communication with discharge opening 24. Air then exhausts through muffler 24*a*.

Figure 6:
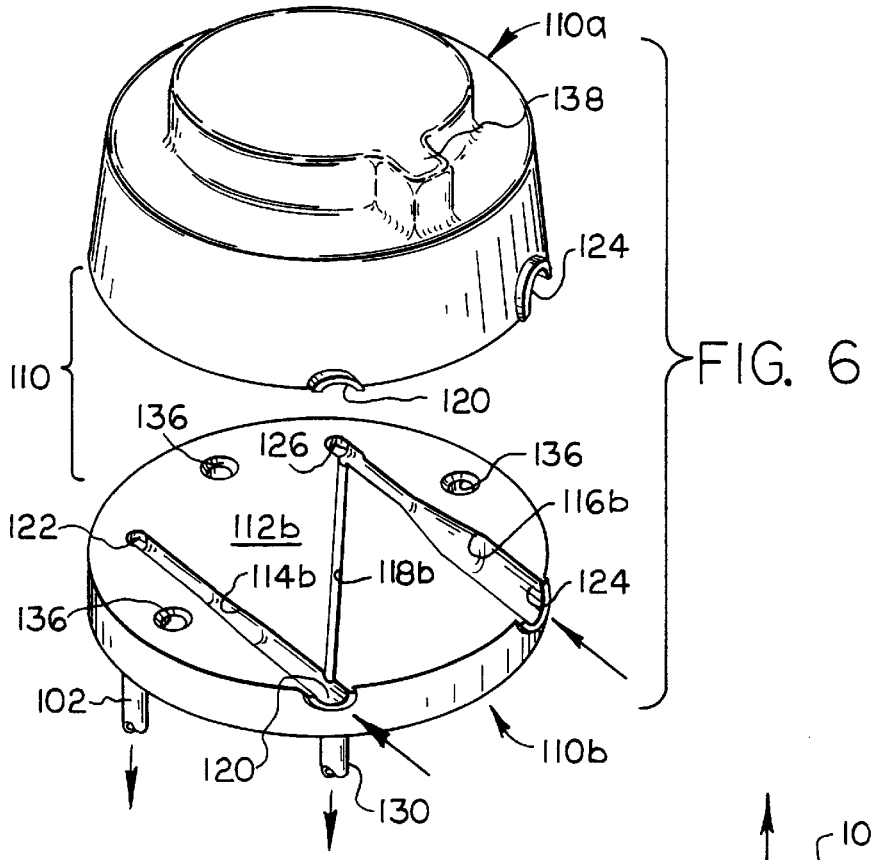
FIG. 6 is an exploded prospective view of a water suction and mixer unit.
Figure 7:
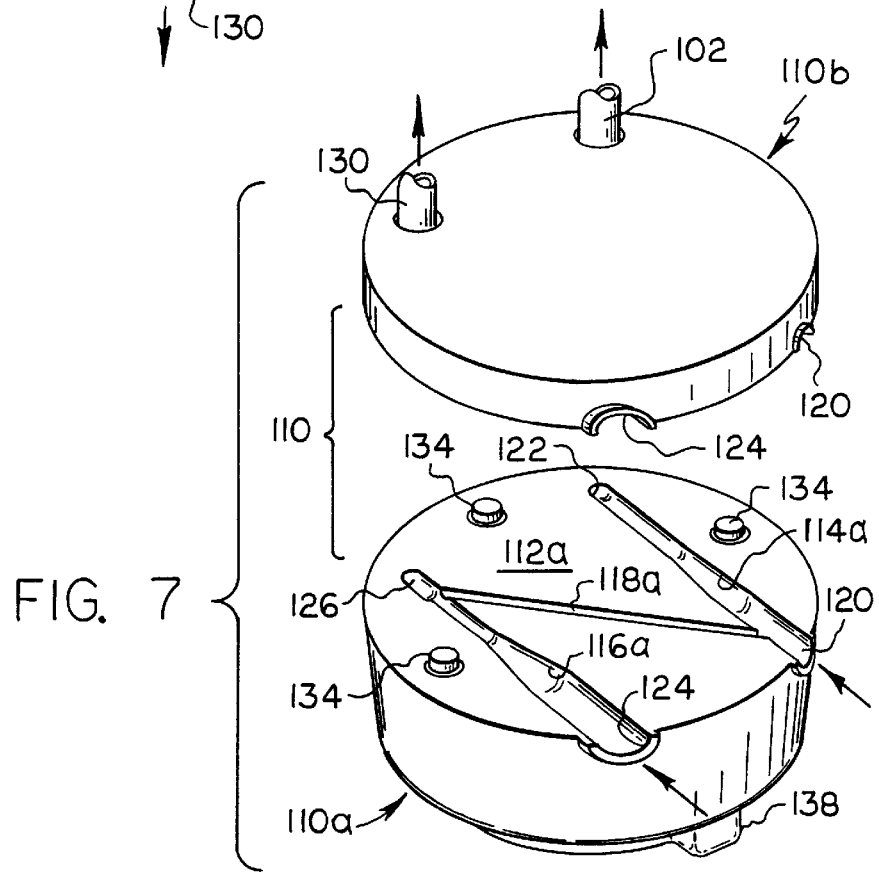
FIG. 7 is a view similar to FIG. 6, but with the unit in inverted condition.

Reference is now made to FIGS. 6 and 7, wherein there is shown a water suction and mixing unit 110 adapted for use in converting the present dry sander to a wet sander. Unit 10 is defined by upper and lower halves 110*a* and 110*b*, which when joined together face-to-face are sized and shaped for close-fitting receipt within the upper end of shell 20. Unit 110 may be suitably retained within shell 20, such as be adhesive. Halves 110*a* and 110*b* are formed with facing surfaces 112*a* and 112*b* shaped to define an air inlet passageway formed from inlet passageway halves 114*a* and 114*b*; a water inlet passageway formed from inlet passageway halves 116*a* and 116*b*; and an air aspirator passageway formed from an aspirator passageway halves 118*a* and 118*b*. Passageway halves 114*a* and 114*b* cooperate to define an air inlet end 120 arranged to communicate with inlet opening 22 and an air inlet 122 disposed in flow communication with flexible tube 102 connected to abovementioned hose fitting 100. Halves 116*a* and 116*b* define a water inlet end 124 arranged to communicate with discharge opening 24 and an air and water outlet end 126 disposed in flow communication with a flexible tube 130 whose lower or other end is coupled in flow communication with the upper end of above-mentioned through opening 46*g* with plug 98 removed. The air aspirator passageway defined by passageway halves 118*a* and 118*b* branches from the air inlet passageway closely adjacent inlet end 120 and enters the water passageway closely adjacent outlet end 126.

Passageway halves 114*a*,114*b*; 116*a*,116*b*; and 118*a*,118*b* are maintained in alignment by a plurality of positioning pins 134 and pin receiving recesses 136. The assembled unit 100 is properly oriented within shell 20 by forming upper half 110*a* with a rib 138 shaped and sized for receipt within a shell recess 140 shown in FIGS. 3 and 4, whereby to place inlet end 120 in flow communication with first opening 22 and inlet opening 124 in flow communication with second opening 24.

In operation of this embodiment of the invention, outlet opening 24 is connected to a suitable source of water by first removing muffler 24*a* and replacing same with a hose connection and a flexible hose extending for example to a bucket of water, not shown. Then upon operation of lever 30, pressurized air is supplied to inlet end 120, whereafter air flows as a first stream through the air inlet passageway, tube 102 and orifice 50*b* for purposes of rotating rotor 44 and as a second stream through the air aspirator passageway into the water passageway for purposes of creating a vacuum condition therein sufficient to draw a stream of water from its source into the water passageway. Air and water mix adjacent outlet end 126 for flow through tube 130, opening 76, opening 46*g*, and a discharge opening 16*a* arranged centrally of sanding pad 16 for application directly to the surface being sanded.

In that with this embodiment of the invention, air exhausted from rotor 44 can not be discharged through second opening 24, due to its being occupied by a hose connection communicating with a water supply, it is necessary to provide another or third opening from chamber 34*a*, such as may be defined by an aperture 34*b* extending radially through sleeve 34 and shown in broken line only in FIG. 4 for purposes of reference.

Figure 10:
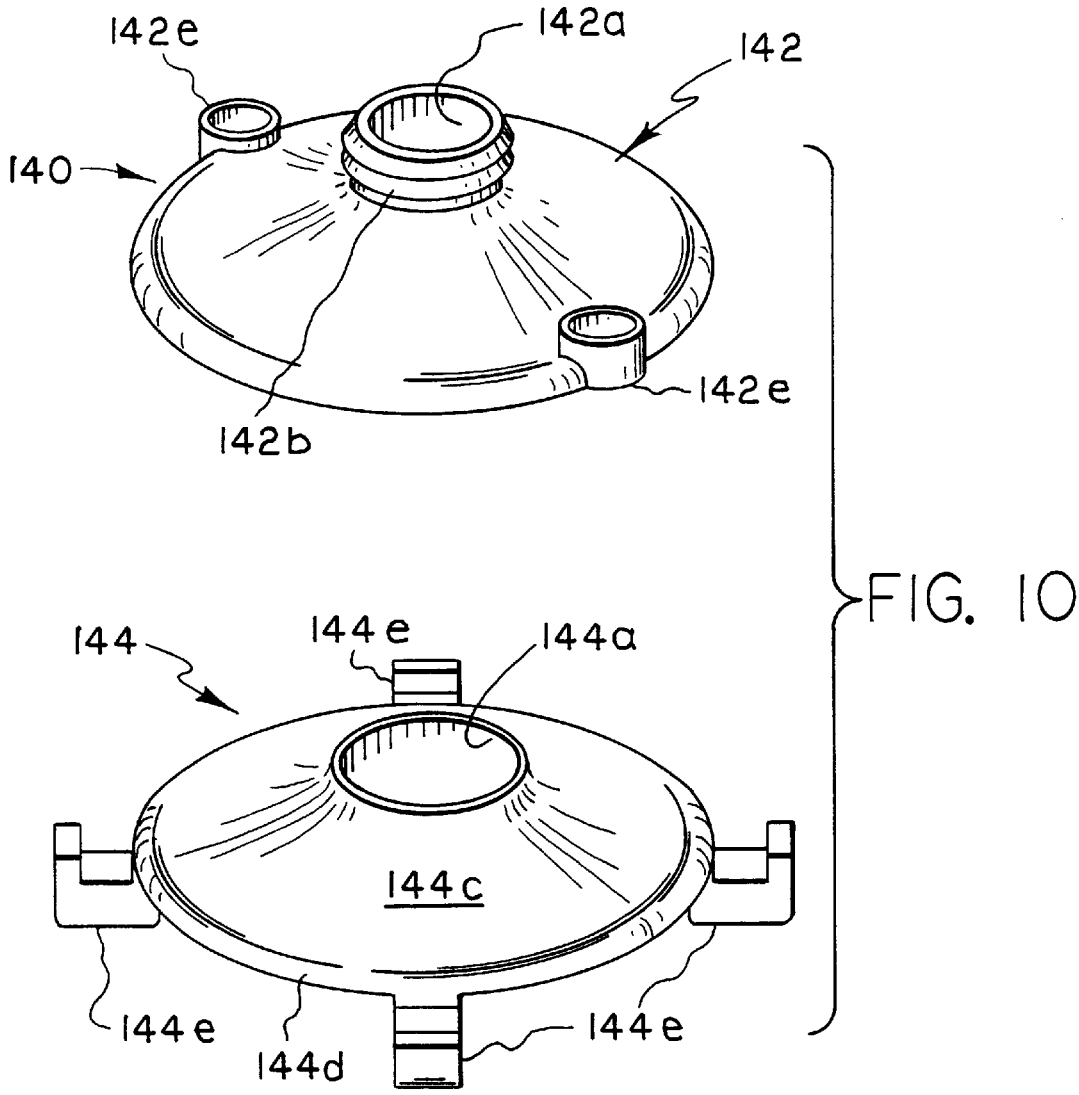
FIG. 10 is an exploded prospective view of the vacuum assist unit.

Reference is now made to FIGS. 8–10, wherein there is shown vacuum assist unit 140 adapted for use in converting the present sander to a vacuum sanding dust exhaust unit. Unit 140 is defined by separately formed, upper and lower molded plastic parts 142 end 144 joined prior to mounting on dome portion 50.

Upper part 142 has a generally cone-shaped configuration provided with a centrally located bore opening 142*a* having an outlet end surrounded by a barbed surface 142*b* for mounting a flexible exhaust tube 148; a convex, annular downwardly facing passageway surface 142*c* terminating inwardly at the lower end of bore opening 142*a* and outwardly at an annular rim 142*d*; and mounting bosses 142*e*, which upstand from adjacent rim 142*d* to receive threaded fasteners, not shown, intended to be threaded into mounting openings 50*e* passing through dome portion upper surface 50*a*.

Lower part 144 also has a somewhat funnel-shaped configuration having a centrally located bore opening 144*a*, having a flared inlet end 144*b*; a concave, annular upwardly facing passageway surface 144*c* terminating inwardly at the upper end of bore opening 144*a* and outwardly at an annular rim 144*d*; and a plurality of mounting and spacer projections 144*e*, which extend radially outwardly of rim 144*d* for attachment, as be adhesive, to an annular inner surface of rim 142*d*. The diameter of bore opening 144*a* is slightly smaller than that of bore opening 142*a*, as shown in FIG. 8. Projections are received within arculate recesses 50*d*,50*d* opening upwardly through dome upper surface 50*a*.

When parts 142 and 144 are joined together, bore openings 142*a* and 144*a* define a stepped, through bore opening or passageway having an annular, upwardly opening air discharge slot or nozzle 150, and passageway surfaces 142*c* and 144*c* cooperate to define a conical, air discharge passageway 152, which has a lower end arranged in flow communication with air discharge openings 78 and an upper end arranged in flow communication with discharge nozzle 150 for discharging air upwardly into bore opening 142*a* as indicated by arrows in FIG. 8. The progressively diminishing thickness and annular extend of passageway 152, as shown in FIG. 8, serves to progressively increase the speed of air exiting through discharge openings 78, so that a vacuum condition is created in bore opening 144*b*, which is sufficient to draw sanding dust upwardly from a work surface being sanded through sanding pad opening 16*a*, rotor mounting shaft opening 46*g*, dome portion through opening 76 and lower bore opening 144*a*, and then transport such dust outwardly of the sander through tube 148 and discharge opening 24. Dust exiting through discharge opening 24 may be collected in a portable bag, not shown suitably attached to the sander or by a remote dust collection vacuum device, not shown, connected to the sander be a flexible hose.

What is claimed is:

1. A hand operated orbital sander having a hand grip portion; a first opening for connection to a source of pressurized air; a second opening; a base portion for mounting a sanding pad and having a chamber, an air inlet for directing air into said chamber and an air outlet for discharging air from said chamber; a resiliently deformable sleeve portion for connecting said base portion to depend from said hand grip portion and defining a conduit for placing said air outlet in flow communication with said second opening; an air operated rotor rotatably supported within said chamber and mounting an eccentric weight for imparting orbital movement to said base portion upon rotation of said rotor; and a flexible tube for connecting said first opening to said air inlet to apply pressurized air to said rotor to effect rotation thereof.

2. A sander according to claim 1, wherein said sleeve portion has an annular, radially outwardly extending mounting flange, said base portion includes a continuous mounting recess for receiving said mounting flange and a clamping plate for clamping said mounting flange within said mounting recess.

3. A sander according to claim 1, wherein said sleeve portion has an annular, radially outwardly extending mounting flange, and said base portion includes a base plate and a clamping plate, said base plate having upper and lower surfaces, a dome portion projecting above said upper surface, a recess opening through said lower surface in alignment with said dome portion and defining said chamber, an inner locating flange projecting from said upper surface and being disposed concentrically of said dome portion, an outer locating flange projecting from said upper surface outwardly of said inner locating flange and cooperating therewith to define a continuous mounting recess, said clamping plate having a centrally located through opening sized to freely receive said sleeve said clamping plate being sized and shaped to overlie said mounting recess and said outer locating flange, and being clamped against said outer locating flange to retain said mounting flange within said continuous mounting recess, and said inlet and said outlet extend through said dome portion.

4. A sander according to claim 3, wherein a pair of spring wire clamps are provided for releasably clamping sand paper to said sanding pad, and said clamping plate and said base plate are provided aligned concave channels cooperating to define bearing supports for supporting said wire clamps for pivotal movement relative to said sanding pad for releasing clamping said sand paper.

5. A sander according to claim 4, wherein said dome portion has a through opening communicating with said chamber, said base portion further includes a rotor mounting shaft and a closure plate, said rotor mounting shaft has a lower end supporting said closure plate and cooperating therewith to close said recess opening through said lower surface, an upper end received within said through opening of said dome portion, an intermediate portion for supporting said rotor for rotation within said chamber, and a lengthwise extending passageway extending through said upper and lower ends.

6. A sander according to claim 5, wherein said upper end of said rotor mounting shaft has a plug for removably closing said passageway thereof for preventing entry of sanding dust into said sleeves and to prevent loss of air thru said passageway.

7. A sander according to claim 1, wherein said base portion includes a base plate, a rotor mounting shaft and a closure plate, said base plate having upper and lower surfaces, a dome portion projecting above said upper surface and a recess opening through said lower surface in alignment with said dome portion and defining said chamber, said dome portion having an upper surface and a through opening communicating with said chamber, said through opening and said fluid outlet extending through said upper surface of said dome portion, said rotor mounting shaft has a lower end supporting said closure plate and cooperating therewith to close said recess opening through said lower surface, an upper end received within said through opening of said dome portion, an intermediate portion for supporting said rotor for rotation within said chamber, and a lengthwise extending passageway extending through said upper and lower ends, and there is further provided in combination a vacuum assist unit fixed to said upper surface of said dome portion and a second flexible tube, said vacuum assist unit having a vertically extending through stepped bore opening including a lower portion communicating with said passageway of said rotor mounting shaft and an upper portion connected to said second opening by said second flexible tube, said lower portion of said stepped bore opening having a smaller diameter than said upper portion of said stepped bore opening and cooperating therewith to define an annular nozzle opening towards said second flexible tube, and said vacuum assist unit having a fluid flow passageway having one end connected to said fluid outlet and another end connected to said nozzle for creating a vacuum condition in said lower portion of said. stepped bore opening for conveying sanding dust upwardly through said passageway of said rotor mounting shaft.

8. A sander according to claim 7, wherein said vacuum assist unit is formed from upper and lower parts, said upper part having a generally cone-shaped configuration provided with a centrally located bore opening defining said upper portion of said stepped bore opening, a convex annular downwardly facing passageway surface terminating inwardly at said bore opening thereof and outwardly at an annular rim, said lower part having a concave annular upwardly facing passageway surface terminating inwardly of said bore opening thereof and outwardly at an annular rim, and a plurality of projections which extending radially of said annular rim of said lower part and have free outer ends thereof connected to said rim of said upper part, and said convex and concave passageway surfaces cooperating to define said fluid flow passageway.

9. A sander according to claim 8, wherein said sleeve portion has an annular, radially outwardly extending mounting flange, and said base portion includes a base plate and a clamping plate, said base plate having upper and lower surfaces, a dome portion projecting above said upper surface, a recess opening through said lower surface in alignment with said dome portion and defining said chamber, an inner locating flange projecting from said upper surface and being disposed concentrically of said dome portion, an outer locating flange projecting from said upper surface outwardly of said inner locating flange and cooperating therewith to define a continuous mounting recess, said clamping plate having a centrally located through opening sized to freely receive said sleeve said clamping plate being sized and shaped to overlie said mounting recess and said outer locating flange, and being clamped against said outer locating flange to retain said mounting flange within said continuous mounting recess, and said air inlet and said air outlet extend through said dome portion.

10. A sander according to claim 9, wherein a pair of spring wire clamps are provided for releasably clamping sand paper to said sanding pad, and said clamping plate and said base plate are provided aligned concave channels cooperating to define bearing supports for supporting said wire clamps for pivotal movement relative to said sanding pad for releasing clamping said sand paper, and said sanding pad has a centrally located through opening arranged for alignment with said lower end of said passageway extending through said rotor mounting shaft.

11. A sander according to claim 1, wherein said base portion includes a base plate fixed to said sleeve portion and having upper and lower surfaces, a dome portion projecting above said upper surface, a recess opening through said lower surface in alignment with said dome portion and defining said chamber, dome portion having a through opening communicating with said chamber, said base portion further includes a rotor mounting shaft and a closure plate, said rotor mounting shaft has a lower end supporting said closure plate and cooperating therewith to close said recess opening through said lower surface, an upper end received within said through opening of said dome portion, an intermediate portion for supporting said rotor for rotation within said chamber, and a lengthwise extending passageway extending through said upper and lower ends, and there is additionally provided in combination a water suction and mixing unit, another flexible tube, and another opening adapted for connection to a source of water, said unit being mounted within said hand grip portion and defining a water passageway having a first end connected to said other opening and a second end connected to one end of said other flexible tube, a first air passageway having a first end connected to said first opening and having a second end connected to said flexible tube, and a second air passageway extending from adjacent said first end of said first air passageway to adjacent said second end of said water passageway for creating a vacuum within said water passageway to draw water thereinto through said other opening, another end of said other flexible tube is connected in flow communication with said lengthwise extending passageway of said rotor mounting shaft, and another end of said flexible tube is connected to said air inlet to apply pressurized air to said rotor.

12. A sander according to claim 11, wherein unit has upper and lower halves having facing surfaces cooperating to define said water passageway, said first air passageway and said second air passageway.

13. A sander according to claim 1, wherein said hand grip portion includes a rigid cup-shaped shell defining said first opening and said second opening and a cup-shaped member of resiliently deformable material partially enclosing said shell, said member defining said sleeve portion, and said flexible tube extends through said conduit between said first opening and said air inlet.

* * * * *